US005350023A

United States Patent [19]

Klemm

[11] Patent Number: 5,350,023

[45] Date of Patent: Sep. 27, 1994

[54] PNEUMATIC HAMMER

[75] Inventor: Guenter W. Klemm, Olpe, Fed. Rep. of Germany

[73] Assignee: Ing. G. Klemm Bohrtechnik GmbH, Fed. Rep. of Germany

[21] Appl. No.: 78,275

[22] PCT Filed: Oct. 23, 1992

[86] PCT No.: PCT/EP92/02434

§ 371 Date: Jun. 22, 1993

§ 102(e) Date: Jun. 22, 1993

[87] PCT Pub. No.: WO93/08363

PCT Pub. Date: Apr. 29, 1993

[30] Foreign Application Priority Data

Oct. 23, 1991 [DE] Fed. Rep. of Germany ..... 4134917

[51] Int. Cl.[5] ..... B23Q 5/033

[52] U.S. Cl. ..... 173/17; 173/78; 173/90; 173/136

[58] Field of Search ..... 173/13, 17, 91, 73, 173/78, 80, 210, 212, 128, 197, 206, 135, 136

[56] References Cited

U.S. PATENT DOCUMENTS 3,958,645 5/1976 Currington ..... 173/17
3,964,551 6/1976 Bassinger ..... 173/80
4,030,554 6/1977 Kammerer, Jr. et al. ..... 173/78
4,530,408 7/1985 Toutant ..... 173/17
4,790,390 12/1988 Sweeny ..... 173/17
4,923,018 5/1990 Meek .
5,131,476 7/1992 Harrington ..... 173/73

FOREIGN PATENT DOCUMENTS 499162 10/1976 Australia .
1472501 5/1977 United Kingdom .

*Primary Examiner*—Scott Smith
*Attorney, Agent, or Firm*—Diller, Ramik & Wight

[57] ABSTRACT

A pneumatic hammer is provided with an adjusting piston (37) dependent on the supply pressure, which adjusts the stroke length of the working piston (16). Thereby, the same pneumatic hammer may be operated both at low and high supply pressures. With high supply pressures, either the early ending of the acceleration phase or the early start of the compression phase or the shortening of the working cylinder shortens the stroke length. Thereby, the pneumatic hammer performs impacts with a substantially constant single-impact energy, regardless of the supply pressure. High supply pressures increase the impact frequency. This results in a considerably improved efficiency at a high drill capacity, a reduced wear and a reduced risk of ruptures of the components of the hammer.

13 Claims, 4 Drawing Sheets

PNEUMATIC HAMMER

BACKGROUND OF THE INVENTION

The invention relates to a pneumatic hammer of the kind mentioned in the precharacterizing part of claim 1.

Such pneumatic hammers are used for ground or rock drilling. They may be implemented in connection with drilling machines that advance and rotate drill rods with a drill bit from a boring frame. In this case, the pneumatic hammer is generally designed as a in-hole hammer which is arranged immediately behind the drill bit in the drill rods. Further, pneumatic hammers may be designed as hand-held hammers, so-called compressed air hammers, which are operated by hand in order to do demolition work or ground and rock work. With a hand-held hammer, the drill bit generally is a simple trepan.

In pneumatic hammers with pin drill bits, the impact energy supplied by the working piston is transmitted to the hard metal pins or bezels for cleaving rock via the drill bit. The impact frequency is determined by the quantity of compressed air supplied or by the quantity transmitted by the pneumatic hammer. By rotating the entire drilling tool, the bottom of the bore hole is cleft and stripped and the drilling material is transported to the outside by the relaxing and outflowing discharge air in the annular gap between the drill rod and the inner wall of the drill rod.

The drilling capacity is chiefly determined by the following factors:

- the single impact energy imparted on the drill bit by the working piston during every blow;
- the number and the surface of the drill bit pins on which the impact energy is distributed and which transform that energy into penetration and cleaving work;
- the impact frequency;
- the pressure of the drilling tool on the bottom of the bore hole;
- the removal of the drillings or the purging or rinsing of the bottom of the bore hole to clean the same of the drillings.

The drive energy required for pneumatic hammers is supplied by compressors. Normally, the supply pressure is about 7 to 10 bar and the supply quantity is about 5 $m^3$/min.

Recently, high pressure compressors are used on building sites that supply a pressure in the magnitude of 20 bars. Such high pressure compressors are also used to drive the pneumatic hammers used on a building site, even if these pneumatic hammers were originally designed for pressures between 7 and 10 bars. For such high pressure operation, the principle of these pneumatic hammers has not been changed; only certain components of the hammer have been provided with a greater strength or a greater thickness. This results in the same pneumatic hammers being operated in a wide range of supply pressures between 7 and 25 bars. With a higher supply pressure, the impact frequency and the impact energy will increase, but the drilling capacity is not enhanced correspondingly. This is due to the fact that the impact energy per drill bit pin is essential for the drilling capacity. The drilling capacity will only be optimal, if the impact energy per drill bit pin is maintained in a certain range. Above this range, the cleaving depth of the rock (cleaving work) is not substantially improved, although the consumption of compressed air increases vastly. Thus, the actual drilling capacity is far behind the installed power of the compressor, which results in a low efficiency. Additionally, a high impact energy of the working piston generates a jarring blow on the anvil. Such jarring blows cause an enormous stress on the drill bit shaft and the working piston, often resulting in ruptures of shafts and pistons. In manually operated pneumatic hammers, the jarring blows caused by an excessive supply pressure entail serious physical stresses on the operator, including the risk of detrimental effects on his health and in particular on the skeletal structure.

The operator of a drilling device will usually obtain the drilling tools, the compressor, the pneumatic hammer and the drill bit from different manufacturers, respectively. As a rule, this leads to an untuned combination of elements being implemented. The operator is not able to select the components such that an optimal drilling capacity with a high efficiency can be obtained with a simultaneous low stress on the material.

SUMMARY OF THE INVENTION

It is an object of the invention to provide a pneumatic hammer that may be operated at different supply pressures and, in a wide range of supply pressures, yields a high drilling capacity with a high efficiency, while simultaneously keeping the stress on the material low.

The object is solved according to the invention with the features of claim 1.

In the pneumatic hammer of the present invention, an adjusting means is provided at the front cylinder wall of the working cylinder, which serves to change the stroke length of the working piston. Thus, the impact energy imparted to the anvil by the working piston may be kept substantially constant in a wide range of supply pressures. At high supply pressures of the compressed air, the piston stroke is reduced so that the piston will hit on the anvil at substantially the same speed as it will at low supply pressures. Despite the great acceleration caused by a high supply pressure, the impact speed on the anvil is not substantially higher than at a low supply pressure, after all. Of course, a high supply pressure and a correspondingly shortener stroke of the working piston will result in a higher impact frequency than would be obtained at low supply pressures. This increases the drilling capacity without reducing the efficiency. The volumetric consumption of compressed air is even reduced.

Preferably, the adjusting means changes the termination of the acceleration phase at the return stroke of the working piston. Thus, the length of the return stroke is changed by changing the kinetic energy imparted to the working cylinder.

in general, it is possible to provide a pneumatic hammer with an adjusting means that is either mounted directly on the hammer housing or may be remote-controlled by means of a transmission device. It is also possible to provide a pneumatic adjusting means, the pressure of which may be adjusted manually irrespective of the supply pressure of the compressed air. Such manual adjusting means allow a user to influence the stroke of the working piston.

In many instances, the operator is not able to adjust the correct stroke length. According to a preferred embodiment it is therefore provided to automatically control the stroke length depending on the supply pressure. This automatic adjusting means is arranged within the pneumatic hammer so that all pressure losses in the conduit system or the rods leading to the pneumatic hammer are taken into account. The supply pressure actuating the adjusting means is not the pressure supplied by the compressor, but the pressure immediately present at the pneumatic hammer, which also causes the acceleration of the working piston.

The supply pressure at the pneumatic hammer does not have to be used unchanged for controlling the djusting means. It is also possible to effect a proportional pressure transformation, for instance, and to control the adjusting means with a pressure depending on the supply pressure.

In addition to the automatic control of the adjusting means, a manual adjusting means may be provided, for instance, in order to adjust the impact energy to the number drill bit pins.

Preferably, the invention is applicable with in-hole hammers that are arranged in a drill rod, as well as with hand-held hammers and demolition hammers. With the latter, maintaining the single-impact energy prevents the transfer of reflected energy into the wrists and arms of the user and the occurrence of damages to the user's health.

In compressors having no adjustable air pressure, or in compressors connected to a plurality of air consumers that require air pressure, the pneumatic hammer automatically adapts itself to the supply pressure, which results in a substantially constant impact energy regardless of the supply pressure and that a high supply pressure merely increases the impact frequency. The components of the pneumatic hammer are subjected to lesser stresses and their service life is prolonged.

The following is a detailed description of embodiments of the invention in conjunction with the accompanying drawings.

BRIEF DESCRIPTION OF THE DRAWINGS

In the Figures

DESCRIPTION OF THE PREFERRED EMBODIMENTS

Figure 1:
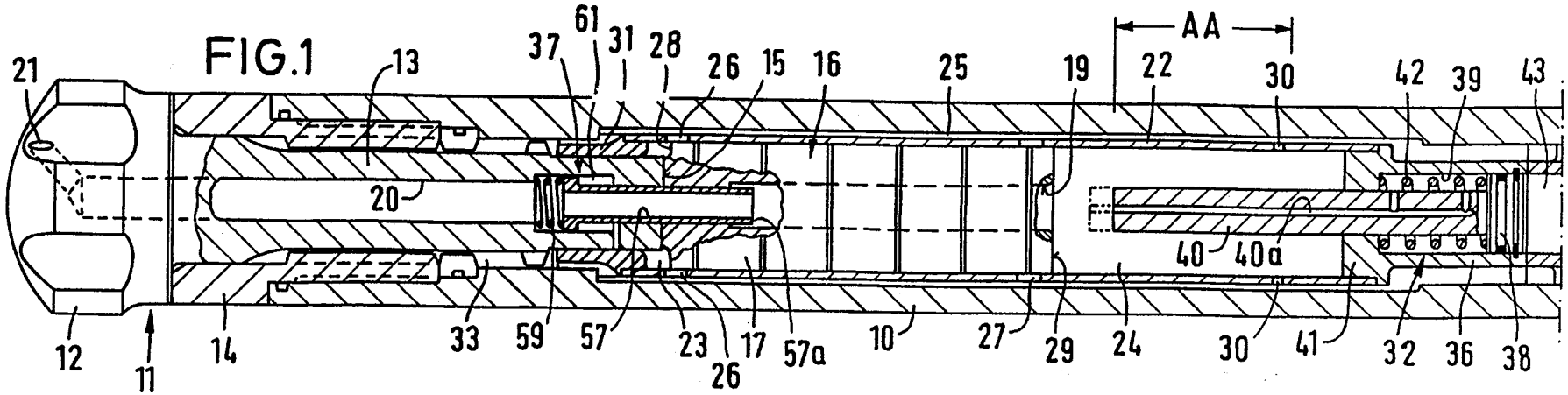
FIG. 1 shows the front portion of a pneumatic hammer as an in-hole hammer in a drill rod.
Figure 2:
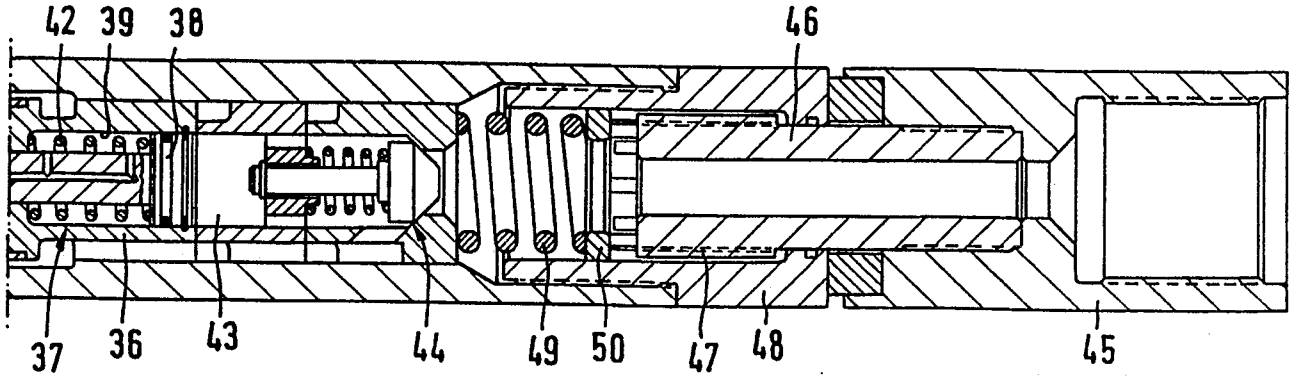
FIG. 2 shows the rear portion of the in-hole hammer of FIG. 1.

The pneumatic hammer illustrated in FIGS. 1 and 2 is a in-hole hammer with an elongated tubular hammer casing 10, from the front end of which the head 12 of a drill bit 11 protrudes. The drill bit head 12 is provided with hard metal pins (not illustrated). The shaft 13 of the drill bit 11 extends into the hammer casing 10. Through a key toothing, the shaft engages an adapter 14 screwed into the hammer casing 10, in order to transmit the rotation of the hammer casing to the drill bit 11. The drill bit shaft 13 is guided for limited longitudinal displacement so that, in case of impacts on the rear end of the shaft 13, the drill bit 11 can shoot forward with respect to the casing 10. The rear end of the drill bit shaft 13 forms the anvil 15 on which the working piston 16 beats. The working piston 16 consists of a piston body 17 with sealing grooves that beats against the anvil 15. A bore 19 extends through the entire length of the piston 16, which is aligned with a longitudinal bore 10 of the drill bit 11. The head 12 of the drill bit is provided with outlets 21 that are connected with the longitudinal bore 20. The expanded discharge air of the pneumatic hammer escapes from these outlets for washing back the drilling material from the bottom of the bore hole.

The piston 16 is guided for longitudinal displacement within the tubular inner cylinder 22, the front cylinder chamber facing the drill bit 11 being designated by the reference number 23, while the rear cylinder chamber facing away from the drill bit bears the reference numeral 24. The inner cylinder 22 is enclosed by an annular channel 25 through which the compressed air is transported over the entire length of the inner cylinder 22. The inner cylinder 22 has radial control bores 26 and 27, the control bore 26 cooperating with a front control surface 28 and the control bore 27 co-operating with a rear control surface 29 of the cylinder body 17. Moreover, the rear end portion of the inner cylinder 22 is provided with a support bore 30 through which compressed air reaches the rear cylinder chamber 24.

Provided at the front end of the working cylinder, there is a guide sleeve 31 fixedly mounted in the hammer casing for a sealed guiding of the shaft 18 of the working piston.

The rear cylinder chamber 24 is limited to the rear by an insert 36 that receives the rear adjusting means 32. The adjusting means 32 includes the adjusting piston 38 displaceable in a control cylinder 39 of the insert 36 and from which a control tube 40 projects forward which extends through a bore of the front cylinder wall 41. The interior of the control tube 40 is always in pneumatic communication with the longitudinal bore 20 and the inside of the control cylinder 39 so that the low relaxed pressure always prevails in the control cylinder 39. A spring 42 is provided in the control cylinder 42 that presses the adjusting piston backward. The rear end of the adjusting piston 38 is connected to a pressure chamber 43 in which the supply pressure constantly prevails.

According to FIG. 2, a check valve 44 is arranged behind the pressure chamber 43, which, in case that pressing water should rise from the drill bit against the compressed air supplied, will block the path of such water. The check valve 44 is actuatable only in the direction from the drill rod 45 to the bottom of the bore hole, but not in the reverse direction.

The rear end of the hammer casing 10 is connected to the front end of the drill rod 45 through an insert member 46, a key toothing 47 of the insert member 46 engaging with a key toothing of a sleeve 48 screwed into the hammer casing. The key toothings permit a limited axial displacement of the hammer casing with respect tot he drill rod 45. A spring 49 is supported on a support ring 50 which in turn is supported on the end of the key toothing of the sleeve 48. The spring 49 presses the fixed inner casing parts of the hammer axially together and permits displacement of these parts due to vibrations.

From the drill rod 45, the compressed air supplied reaches the pressure chamber 43 and the annular channel 25 through the hollow insert 46 and via the check valve 44.

Figure 3:
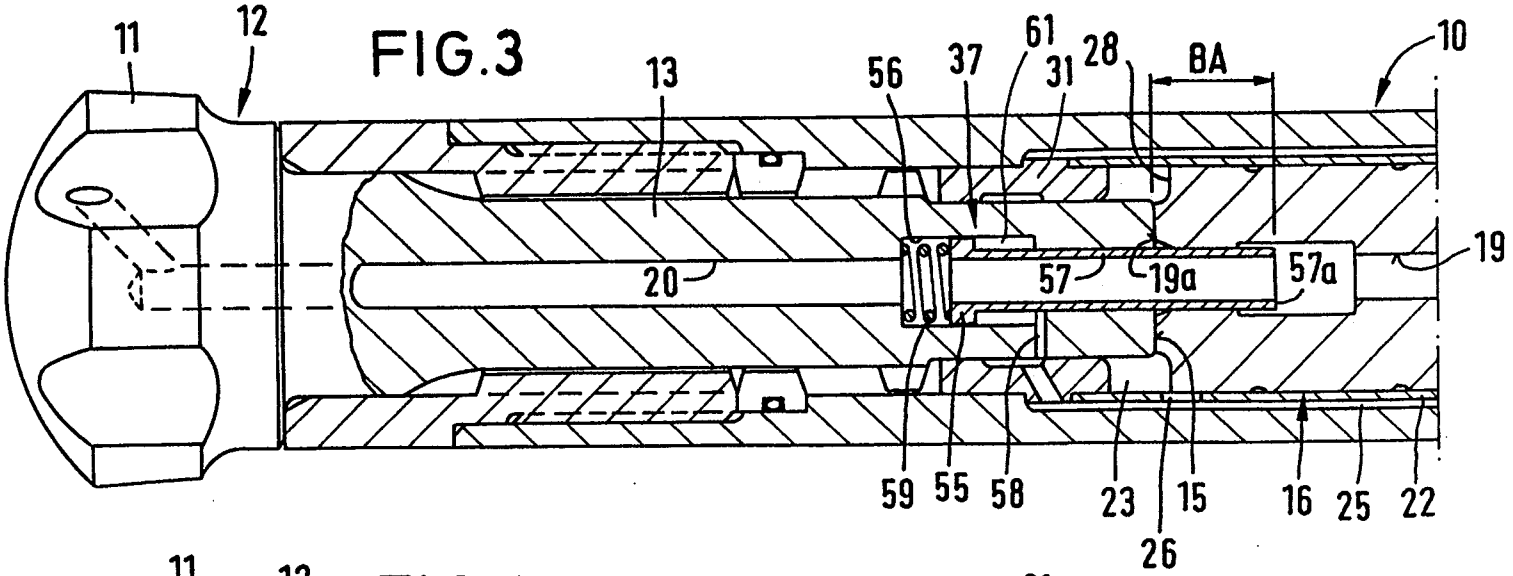
FIG. 3 is an upscaled illustration of the adjusting means arranged at the front end of the working cylinder.

According to FIG. 3, the adjusting means 37 arranged at the front end of the working cylinder for changing the end of the acceleration phase is integrated into the drill bit shaft 13. It has an annular control piston 55 that is axially displaceable within a control cylinder 56 provided in the shaft 13 and from which a control tube 57 projects towards the bore 19 of the working piston. The control tube 57 may enter the bore 19 of the control piston 56. If, during the return stroke, the front end 19*a* of the bore 19 passes the rear edge 57*a* of the control tube 57, the pressure in the front cylinder chamber 23 is relieved through the inside of the control tube 57 towards the pressure-free axial bore 20.

The adjusting cylinder 61 in which the adjusting piston 55 moves, is connected to the pressurized annular channel 25 through a channel 58 so that the supply pressure acts on the annular surface of the control piston 55. This supply pressure is counteracted by the spring 59. When the force of the control piston generated by the supply pressure exceeds the force of the spring 59, the control tube 57 is displaced forward within the working cylinder. This means that the position of the rear edge 57*a* changes according to the supply pressure. At higher supply pressures, the compression phase is shortened since, starting from the front end position of the working cylinder, the rear edge 57*a* is passed by earlier than at lower supply pressures. Thereby, a lesser energy is imparted to the piston during the return stroke at high supply pressures, which results in the forming of a pressure cushion with a lower compression in the rear cylinder chamber 24. The return stroke (and, accordingly, the working stroke) of the working piston is shortened.

The pneumatic hammer depicted in FIGS. 1 to 3 operates as follows:

In FIG. 1, the piston 16 is illustrated as being in its front end position in which the shaft 18 abuts the anvil 15. The front cylinder chamber 23 is reduced to a minimum and is connected to the pressure in the annular channel 25 through the control bore 26. In this situation, the return stroke of the working piston 16 begins since the rear cylinder chamber 24 is connected to the pressureless longitudinal bore 20 of the drill bit through the bore 19. During the return stroke, the working piston 16 experiences an acceleration phase. The pressure prevailing in the front cylinder chamber 23 and acting on the front control surface 28 accelerates the working piston. This acceleration phase will last until the front edge 19*a* of the working piston 16 has left the rear end 57*a* of the control tube 57. The corresponding acceleration section BA is marked in FIG. 3. After this, the cylinder chamber 23 is connected to the pressureless axial bore 20. The acceleration is followed by an idle phase in which the return stroke of the working piston is not driven. The air displaced from the rear cylinder chamber 24 is discharged through the bore 19 in the working piston.

When the rear control surface 29 of the working piston reaches the front end of the control tube 40, the idle phase is ended. Next to follow is the compression phase in which the air in the annular chamber of the working cylinder surrounding the control tube 40 is compressed. The control tube 40 now closes the opening of the bore 19. The air trapped in the cylinder chamber 24 forms an air cushion that slows down the rearward movement of the working piston. Now the working stroke is effected in which the air cushion compressed in the cylinder chamber 24 expands and drives the working piston in the direction of impact. This driving force is even augmented by the air passing through the support bore 30. The drive phase ends when the rear control edge 29 of the working piston has passed the front end of the control tube 40. The drive section, in which the working piston is accelerated in the direction of the impact, is indicated by AA in FIG. 1.

At the end of the working stroke, the shaft 18 of the working piston hits the anvil 15, an air cushion having been formed in the front cylinder chamber 23 short before the impact.

The operation described before refers to cases where the supply pressure of the compressed air has a comparatively low value of about 7 to 10 bars. Such a pressure in the pressure chamber 43 is overcome by the spring 42 so that the adjusting piston 38 is moved into its rear end position against this pressure and that the control tube 40 also takes its rear end position.

If the control pressure is higher, the adjusting tube 57 is advanced together with the control tube 40, the distance of advancement being dependent on the supply pressure. With a higher supply pressure, the acceleration phase is terminated earlier, i.e. it is shortened. Moreover, the control surface 29 reaches the front end of the control tube 40 earlier so that the compression phase will begin earlier. This reduces the stroke of the piston (return stroke) so that the following working stroke of the working piston begins at a location closer to the front side. At a higher supply pressure, the stroke of the working piston is reduced so that, despite the higher supply pressure, the speed at which the working piston hits on the anvil is substantially the same as the impact speed that is obtained at a lesser supply pressure and with the control tube 40 withdrawn.

The advanced position of the control tube 40 may be selected such that, during the return stroke, the acceleration phase and the compression phase follow each other immediately or even overlap without an intermediate idle phase.

Figure 4:
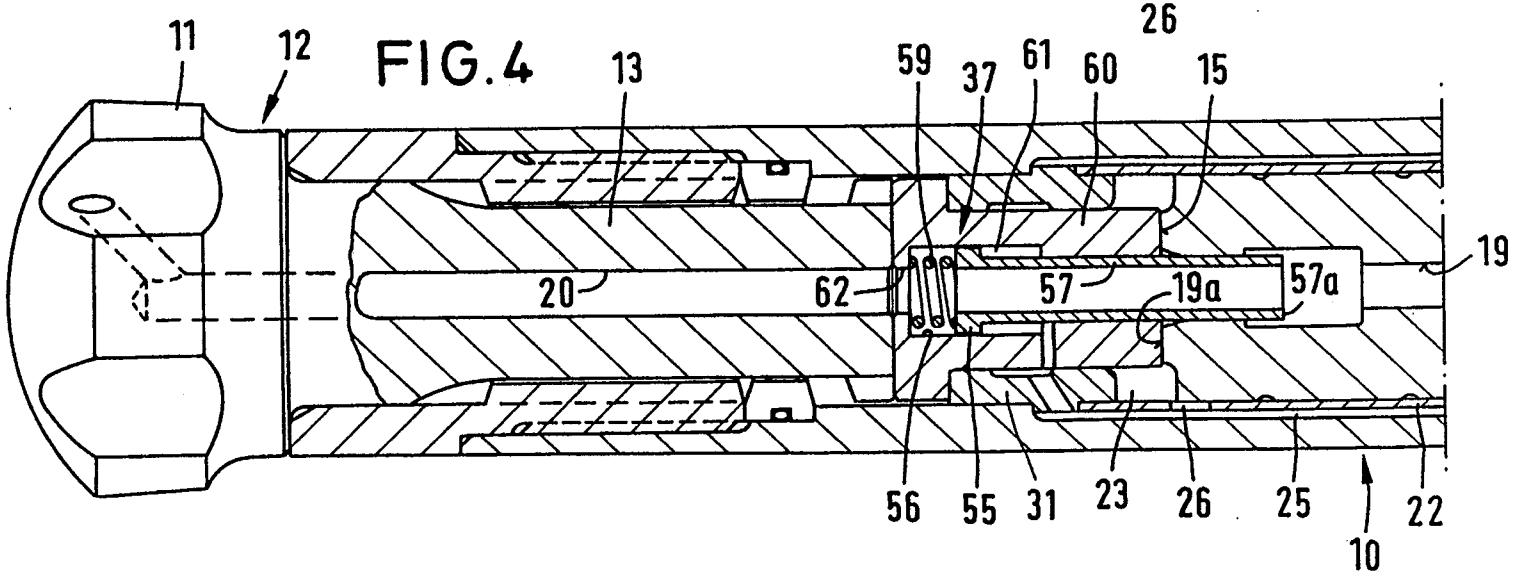
FIG. 4 shows an embodiment slightly modified with respect to that of FIG. 3.

The embodiment of FIG. 4 differs from that of FIG. 3 only in that the adjusting means 37 is not integrated into the shaft of the drill bit 12, but is accommodated in a block 60 at which the anvil 15 is provided and which abuts the shaft 13 with its front end. The adjusting cylinder 61 of the adjusting means 37 closed by the control piston 55 is connected to the annular channel 25 and permanently connected to the supply pressure. A bore 62 extends from the cylinder 56 to the axial bore 20 of the drill bit.

Figure 5:
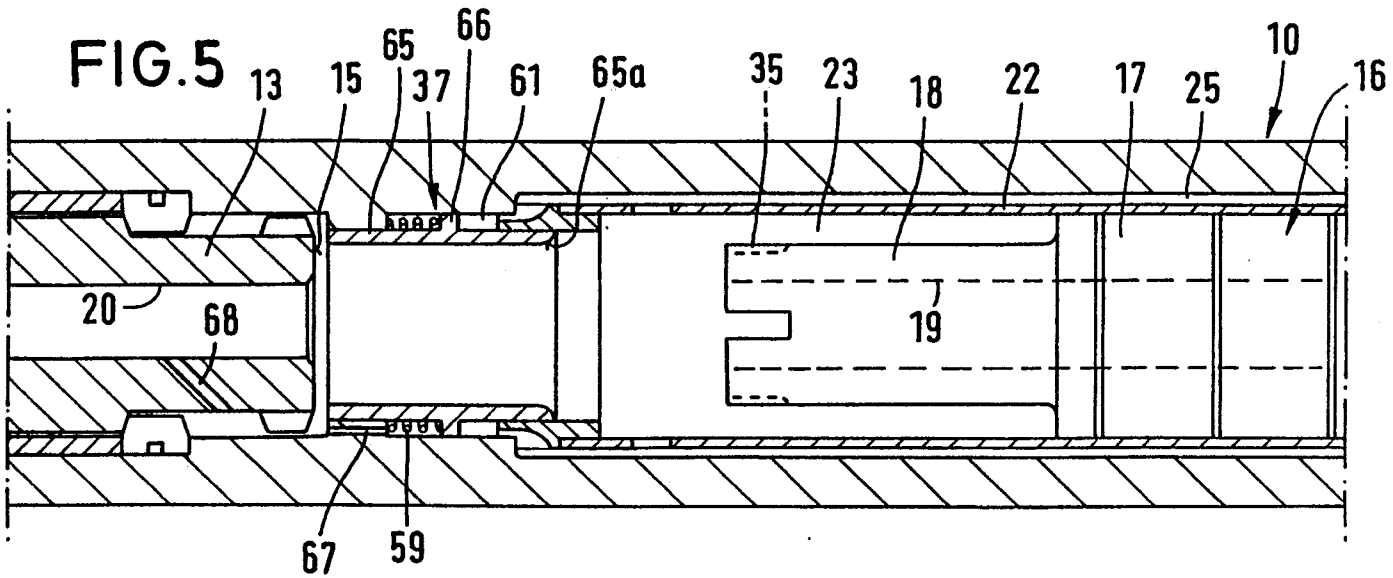
FIG. 5 shows an embodiment in which the adjusting means has a control sleeve.

According to FIG. 5, the adjusting means 37 is also arranged at the front end of the working cylinder. The adjusting element consists of a hollow control jacket 65 having an annular collar formed thereon which forms the control piston 66. A spring 59 presses the control piston 66 and the control jacket 65 towards the working cylinder. The pressure exerted by the spring 59 is counteracted by the supply pressure prevailing in the annular space 61. The cylinder chamber containing the spring 59 is connected to the axial bore 20 of the drill bit through bores 67 and bores 68 in the shaft, and, therefore, it is pressure-free.

In this embodiment, the working piston 16 has a shaft 18 that enters the control jacket 65 and hits against the anvil 15. During the return stroke, the acceleration phase is ended when the rear ends of the grooves 35 in the shaft 18 reach the rear edge 65*a*of the control jacket 65. With high supply pressures, this will occur earlier than with low supply pressures. In this way, the return stroke of the working piston is reduced when a high supply pressure prevails.

Figure 6:
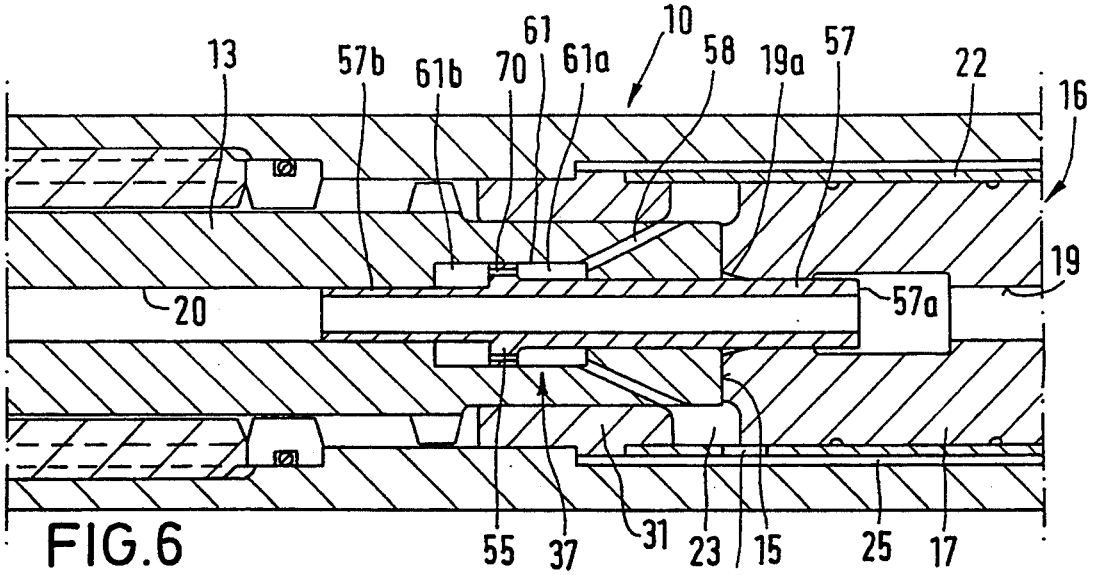
FIG. 6 shows an embodiment without a restoring spring in the adjusting means.

The embodiment of FIG. 6 largely corresponds to the embodiment of FIGS. 1 to 3 so that the following description is limited to the differences. The control tube 57 that extends towards the cylinder chamber 23 of the working cylinder, has a tubular prolongation 57*b* pointing to the opposite direction (i.e. forward), which is sealingly movable in the axial bore 20 of the drill bit shaft 13. The outer diameter of the prolongation 57*b* is smaller than that of the rearward directed main portion of the control tube 57 so that the control piston 55 has opposite piston surfaces of different size.

The adjusting piston 55 divides the adjusting cylinder into a first cylinder chamber 61*a* and a second cylinder chamber 61*b*. The first cylinder chamber 61*a* is in permanent connection with the front cylinder chamber 23*a* of the working cylinder through the bore 58. The second cylinder chamber 61*b* is completely sealed by the adjusting piston 55 and the prolongation 57*b* and is connected to the first cylinder chamber 61*a* only through a throttle bore 70 extending through the adjusting piston 55.

In the front end position of the working piston 16, as depicted in FIG. 6, i.e. at the beginning of the return stroke, the rear end 57*a* of the control tube 57 plunges into the channel 19 of the working cylinder so that the front cylinder chamber 23 is cut off from the pressure-free axial bore 20. This cylinder chamber is thus supplied with compressed air via the bores 26 from the annular channel 25. This pressure reaches the first cylinder chamber 61*a* of the adjusting piston through the channel 58. Thereby, the adjusting piston 55 is deplaced to the left, as shown in FIG. 6, whereby the air in the second cylinder chamber 61*b* is compressed. This compression is the greater the greater the supply pressure prevailing in the first cylinder chamber 61*a* is. The supply pressure increasing, the control tube 57 is drawn into the drill bit shaft so that its end 57*a* moves forward. When the piston is returned after the impact of the piston 16 on the anvil 15, the end 19*a* will move along the end 57*a* of the control tube, whereby the pressure in the front cylinder chamber 23 may expand into the axial bore 20. The first cylinder chamber 61*a* will become pressure-free and the air contained in the second cylinder chamber 61*b* expands and moves the adjusting piston 55 back into the (right) end position which is the initial position of the adjusting piston and the control tube for the next stroke of the working piston. The throttle bore 70 serves as a charging and compensating bore for the cylinder chamber 61*b*. It is dimensioned such that the time required for a pressure compensation between the cylinder chambers 61*a* and 61*b* is much longer than the duration of a stroke of the working piston. The control tube 57 will meet the working piston in its rear end position, respectively, and, during the impact, takes a position that corresponds to the supply pressure. This position is maintained until the working piston has left the control tube again and the cylinder chamber 23 becomes pressure-free.

The different sizes of the piston surfaces of the adjusting piston 55 ensure that the adjusting piston will return to its (right) home position, if the same pressure prevails in both cylinder chambers 61*a* and 61*b*. This effect is even reinforced by the suction effect generated when the working piston 16 leaves the front end 57*a* of the control tube.

Figure 7:
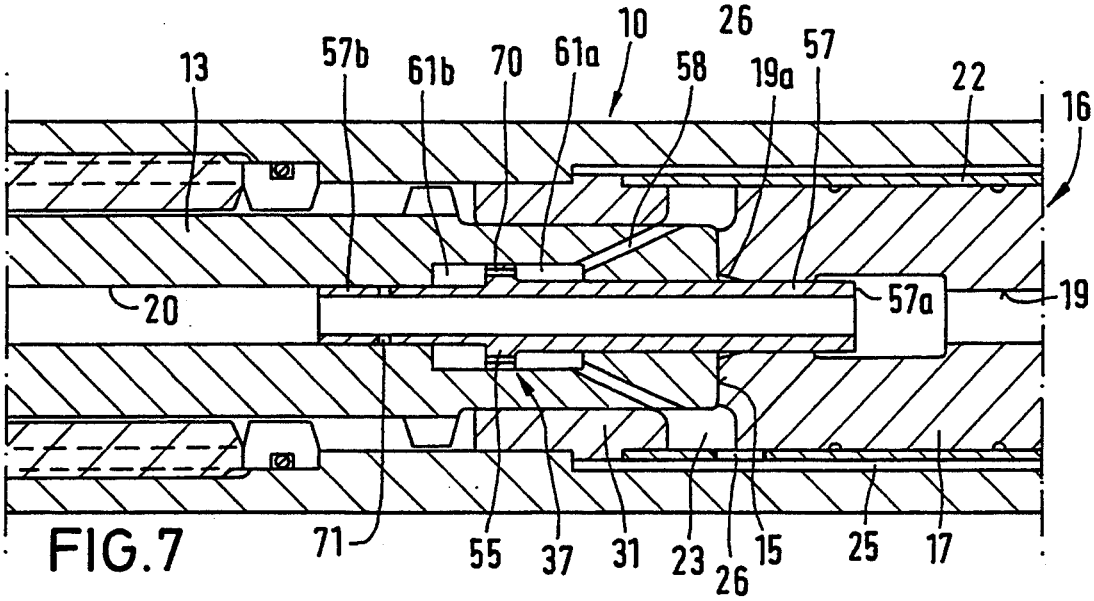
FIG. 7 shows an embodiment modified with respect to that of FIG. 6.

The embodiment of FIG. 7 differs from that of FIG. 6 only in that a further throttle bore 71 is provided in the wall of the prolongation 57*b* of the control tube 57. Only when the control tube 57 is extended almost completely, will this throttle bore 71 leading into the axial bore 20 be located in the area of the second cylinder chamber 61*b* of the adjusting cylinder. The throttle bore 71 compensates the possibly building boost pressure of the second cylinder chamber 61*b*, thereby creating constant initial conditions for the control tube 57 at every switching. Further, the bore 71 has the effect that condensation water that might gather in the second cylinder chamber 61*b*, ground water, oil and other liquids are purged into the axial bore 20.

Figure 8:
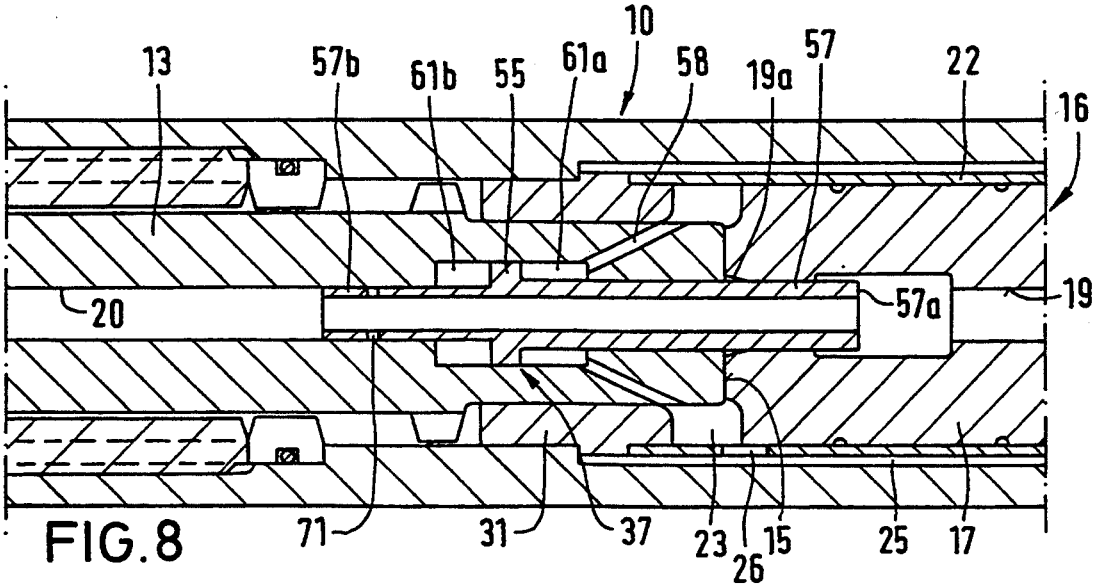
FIG. 8 shows an embodiment modified with respect to that of FIG. 7.

The embodiment of FIG. 8 corresponds to that of FIG. 7, differing only in that the piston 55 has no throttle bore 70. Only the prolongation 57*b* of the control tube 57 is provided with a throttle bore 71 that corresponds to that of FIG. 7. The cylinder chamber 61*b* is discharged or neutralized in the respective switching position only through the throttle bore 71. It is the advantage of this embodiment that the control tube 57 travels longer displacement paths so that the stroke of the working piston changes a lot in dependence on the supply pressure. It is a further advantage that a back pressure building in the axial bore 20 influences the adjusting means 37 such that the stroke of the working piston is prolongated and the impact capacity is increased.

Although a preferred embodiment of the invention has been specifically illustrated and described herein, it is to be understood that minor variations may be made in the apparatus without departing from the spirit and scope of the invention, as defined the appended claims.

I claim:

1. A pneumatic hammer having a working piston (16) movable in a working cylinder, said piston imparting impacts onto a drill bit via an anvil (15), and control members provided at said working cylinder and said working piston, which control a supply of compressed air to front and rear cylinder chambers (23, 24) at both ends of said working piston and which cooperate such that, during a return stroke, said working piston performs an acceleration phase and an air compression phase and that, during a subsequent forward directed working stroke, said working piston performs a drive phase and an impact on said anvil (15), characterized in that at a front end of said working cylinder there is provided a reciprocable adjusting means (37) for adjusting the length of the return stroke of said working piston in dependence on the supply pressure of the compressed air.

2. The pneumatic hammer of claim 1, wherein said adjusting means (37) is controlled by the supply pressure such that, in case of a higher supply pressure, the stroke length is reduced.

3. The pneumatic hammer of claim 1, wherein said adjusting means (37) adjusts one of said control members (57; 65) that determines the end of the acceleration phase (57; 65) phase in the return stroke.

4. The pneumatic hammer of claim 1, wherein said adjusting means (37) adjusts one of said control members (40) that determines the beginning of the compression phase in dependence on the supply pressure.

5. The pneumatic hammer of claim 1, wherein said adjusting means (37) has an adjusting piston (55; 66) movable in an adjusting cylinder (61) and actuated by the supply pressure.

6. The pneumatic hammer of claim 5, wherein said front cylinder chamber (23) of said working cylinder is connected to a first cylinder chamber (61*a*) of said adjusting cylinder (61) and a second cylinder chamber (61*b*) of said adjusting cylinder communicates with said first cylinder chamber (61*a*), and a discharge channel (20) through first and second throttle bores, respectively (70; 71).

7. The pneumatic hammer of claim 6, wherein a piston surface of said adjusting piston (55) defining a portion of said first cylinder chamber (61*a*) is smaller than a piston surface of said adjusting piston defining a portion of said second cylinder chamber (61*b*).

8. The pneumatic hammer of claim 6, wherein said first throttle bore (70) extends through said adjusting piston (55).

9. The pneumatic hammer of claim 6, wherein said second throttle bore (71) is provided through a wall of said control tube (57).

10. The pneumatic hammer of claim 9, wherein said second throttle bore (71) enters said second cylinder chamber (61*b*) only in a withdrawn position of said adjusting cylinder.

11. The pneumatic hammer of claim 5, wherein said adjusting piston (55) is connected with a control tube (57) projecting into said working cylinder, which is receivable may plunge into a longitudinal bore (19) of said working piston (16).

12. The pneumatic hammer of claim 5, wherein said adjusting piston (66) is connected with a control sleeve (65) for receiving a shaft (18) of said working piston (16).

13. The pneumatic hammer of claim 12, wherein said adjusting piston (66) is an annular piston located on said control sleeve (65).

* * * * *